US006905277B2

(12) United States Patent
Saito et al.

(10) Patent No.: US 6,905,277 B2
(45) Date of Patent: Jun. 14, 2005

(54) LIQUID APPLICATOR

(75) Inventors: Takatoshi Saito, Koto-ku (JP); Yoshiyuki Murata, Koto-ku (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 0 days.

(21) Appl. No.: 10/739,182

(22) Filed: Dec. 19, 2003

(65) Prior Publication Data

US 2005/0042020 A1 Feb. 24, 2005

(30) Foreign Application Priority Data

Aug. 20, 2003 (JP) ..... 2003-296931

(51) Int. Cl.[7] ..... A46B 11/04; A47L 13/22

(52) U.S. Cl. ..... 401/281; 401/270; 401/282; 401/286

(58) Field of Search ..... 401/126, 129, 401/130, 205, 263, 265, 266, 270, 272, 277, 401/280–284, 286, 288

(56) References Cited

U.S. PATENT DOCUMENTS 2,702,396 A * 2/1955 Straszer ..... 401/281
4,748,990 A * 6/1988 Brown et al. ..... 401/277

* cited by examiner

*Primary Examiner*—Tuan Nguyen
(74) *Attorney, Agent, or Firm*—Oliff & Berridge, PLC

(57) ABSTRACT

The present invention, there is provided a liquid applicator in which an application member is attached to a mouth portion of a container in order to apply contents such as cosmetics, chemicals or the like. The mouth portion of the container has a barrel part formed with threads. The container mouth portion is fitted therein with an inner plug formed therein with a passage hole communicated with the inside of the container. The application member includes a discharge barrel for opening and closing the passage hole in the inner plug, an application element holder fitted therein with the discharge barrel and holding an application element, and an attachment cap formed with threads adapted to be threadedly engaged with the thread of the barrel part.

8 Claims, 7 Drawing Sheets

LIQUID APPLICATOR

BACKGROUND OF THE INVENTION

1. Technical Field

The present invention relates to a liquid applicator for cosmetics, chemicals or the like, and in particular to a liquid applicator having an application member fitted to a mouth portion of a container, for applying contents in the container.

2. Prior Art

A liquid applicator for applying contents in a tube container is known and disclosed, for example, in Japanese Utility Mode Laid-Open Publication No. 02-50226, wherein an application member in the form of a brush is fitted to a mouth portion of a tube container and the contents in the container is applied by the brush while pressing the container. This type of liquid applicator suffers from a problem that, should the container be accidentally pressed, either the contents is discharged into and accumulated in an over-cap for covering the application brush when it is not in use, or the contents push up the over-cap so as to be discharged outside.

A liquid application container is also known and disclosed, for example, in Japanese Utility Model Laid-Open Publication No. 51-159665, wherein an inner plug having a valve hole is fitted into a mouth portion of the container. The inner plug serves to support a movable member provided with a valve element at its lower end and holding, in its upper part, a porous application member, through the intermediary of a spring. Further, a cap is engaged with the movable member and screwed onto the outer periphery of the mouth portion of the container. In this liquid application container, the cap is opened or closed so as to establish or shut off a passage between the inner plug and the application member, and it would be desirable to solve various problems as follows. First, should the cap be left opened, depending upon the kind of the contents, a volatile component of the contents, if any, evaporates so as to cause solidification of the contents. Second, should the container be accidentally grasped, the contents are readily discharged. Furthermore, since the inner plug prevents withdrawal of the movable member, the application member cannot be readily removed, with the result that contamination to the application member or solidified liquid cannot be washed away with water or washing liquid. Moreover, a spring is arranged at the outer periphery of the valve element, so that this type of arrangement can hardly be applied to a small-sized container.

SUMMARY OF THE INVENTION

The present invention intends to eliminate the above-mentioned problems of the prior art.

The present invention is based on a novel concept that there can be realized an improved liquid applicator in which a passage between an inner plug and an application member can be opened or closed by rotating an attachment cap fitted therein with the application member in a predetermined angular range, and the application member can be removed by further rotating the attachment cap.

To this end, according to the present invention, there is provided a liquid applicator comprising a container including a mouth portion having a barrel part formed with threads, an inner plug having a peripheral wall fitted in the mouth portion of the container, and a bottom wall, and formed with a passage hole communicated with the inside of the container, a discharge barrel for opening and closing the passage hole of the inner plug, an application member holder fitted with the discharge barrel, and holding an application element, and an application member including an attachment cap formed with threads adapted to be threadedly engaged with the threads on the barrel part.

According to the present invention, with the configuration in which the inner plug is formed therein with the passage hole, and the application member is provided with the discharge barrel for opening and closing the passage hole, the passage between the inner plug and the application member can be opened or closed by rotating the attachment cap in a predetermined range. Moreover, the application member can be removed by further rotating the attachment cap, and the attachment cap can thus be easily washed after removal thereof.

In a preferred embodiment of the liquid applicator, the mouth portion of the container is formed at its upper end part with a locking ring which is projected therefrom while the attachment cap is formed at the inner surface thereof with a bead ring adapted to be engaged with the locking ring, so that the rising position of the attachment cap is limited by the locking ring of the mouth portion, but the locking ring is allowed to ride over the bead ring through further rotation of the attachment cap.

The application element in the application member is preferably formed of bristle or a porous application element, wherein the porous application element may be made of suitable synthetic resin, synthetic rubber or the like.

The passage hole in the inner plug is formed in either or both of the peripheral wall and the bottom wall, and may be formed, being extended between the peripheral wall and the bottom wall.

BRIEF DESCRIPTION OF THE DRAWINGS

The present invention will be further described below with reference to the preferred embodiments shown in the accompanying the drawings.

DESCRIPTION OF PREFERRED EMBODIMENTS

Figure 1:
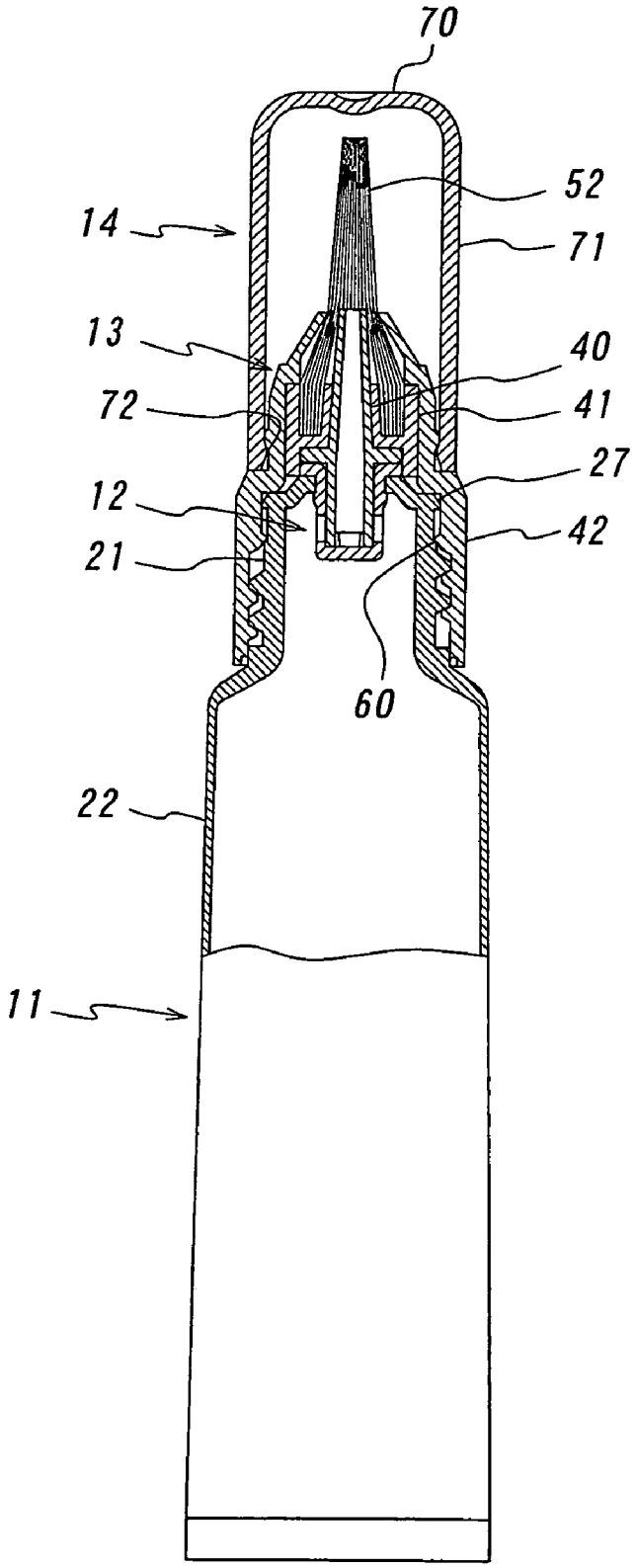
FIG. 1 is an elevation view, partly in section, of a liquid applicator according to a preferred embodiment of the present invention.

Referring to FIG. 1, a liquid applicator according to the present invention has a container 11 which stores therein, as contents, cosmetics such as lip cream, lip color, chemicals or the like, and is used as a tool for application of cosmetics, chemicals or the like, and incorporates, in addition to the container 11, an inner plug 12, an application member 13 and a cover cap 14 which will be explained later.

Figure 2:
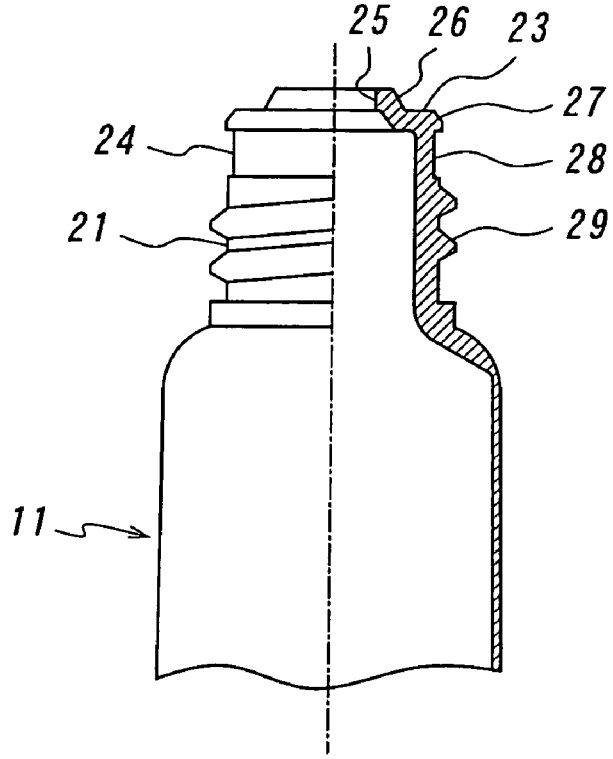
FIG. 2 is a half-cut elevation view illustrating a mouth portion of the container.

Referring to FIGS. 1 and 2, the container 11 is a tube container having a mouth portion 21 and a barrel 22 which can be deformed by being pressed. The mouth portion 21 is composed of a top wall 23 and a barrel part 24, the top wall 23 being formed therein with a step part 26 having an opening 25 in its center part. The barrel part 24 is formed at its upper end with a locking ring 27 projected outward, and has an upper reduced diameter part 28 and a thread part formed therein with threads 29 below the locking ring 27.

Figure 3A:
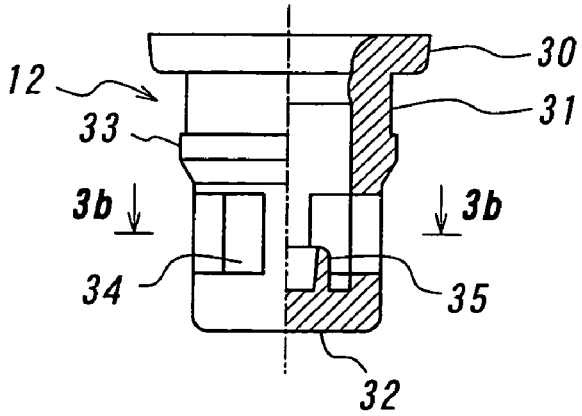
FIG. 3*a* is a half-cut elevation view illustrating an inner plug.
Figure 3B:
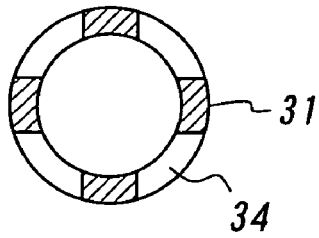
FIG. 3*b* is a cross-sectional view taken along the line 3*b*-3*b* in FIG. 3*a*.

Referring to FIGS. 3*a* and 3*b*, the inner plug 12 comprises a peripheral wall 31 formed at its upper end with a flange 30 and a bottom wall 32. The peripheral wall 31 is formed below the flange 30 with a locking ring 33 which is engaged with the lower end edge of the opening 25, and is formed further therebelow with a plurality of passage holes 34 at equal intervals. The bottom wall 32 is provided inside of the peripheral wall 31 with a locking ring 35.

Figure 4:
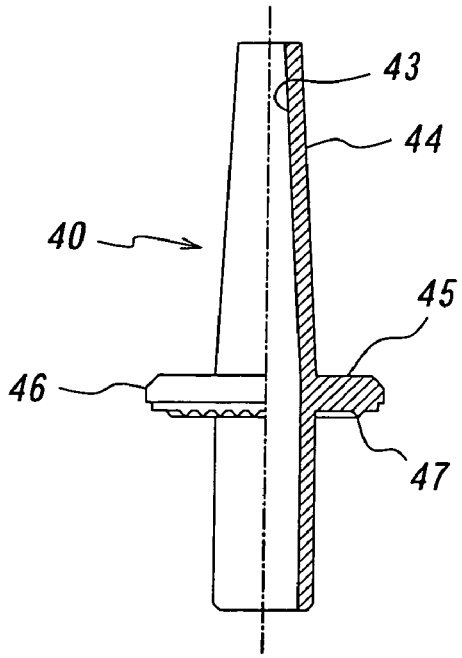
FIG. 4 is a half-cut elevation view illustrating a discharge barrel.

With reference to FIG. 1, the application member 13 is composed of a discharge barrel 40, a bristle holder 41 and an attachment cap 42. With further reference to FIG. 4, the discharge barrel 40 is composed of a barrel body 44 formed therein with a discharge hole 43, and a flange 45 projected from the intermediate part thereof. The lower end of the barrel body 44 is adapted to be fitted between the lower part of the peripheral wall 31 and the locking ring 35 of the inner plug 12, and the flange 45 is formed at the peripheral edge thereof with a projecting ring 46 which is projected therefrom, and at its lower surface with a bead ring 47.

Figure 5A:
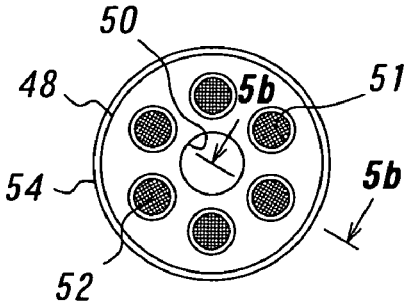
FIG. 5*a* is a plan view illustrating a bristle holder.
Figure 5B:
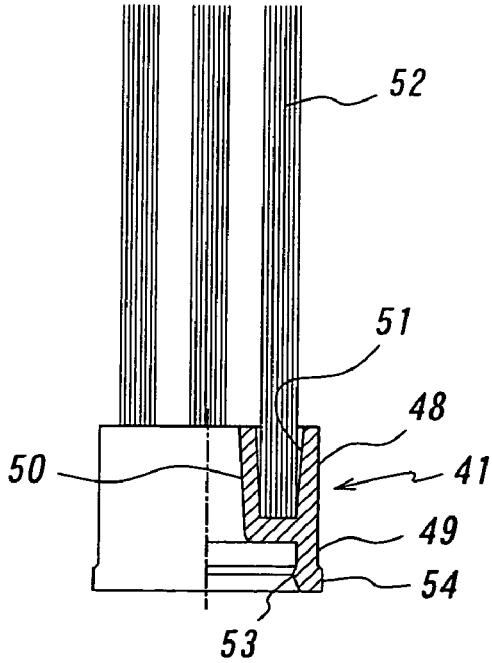
FIG. 5*b* is a half-cut elevation view taken along the line 5*b*-5*b* in FIG. 5*a*.

With reference to FIGS. 5*a* and 5*b*, the bristle holder 41 comprises a bristle holding part 48, and a discharge barrel holding part 49 suspended along the peripheral edge of the bristle holding part 48. The bristle holding part 48 is formed in the center part thereof with an insertion hole 50 fitted therein with the discharge barrel 40, and at the upper surface of the periphery thereof with a plurality of bristle holding holes 51 in which bristle 52 is planted. The discharge barrel holding part 49 is formed at the inner periphery of the lower end thereof with a bead ring 53 adapted to be engaged with the projecting ring 46 of at the peripheral edge of the flange 45, and at the outer periphery of the lower end with a projecting ring 54.

Figure 6:
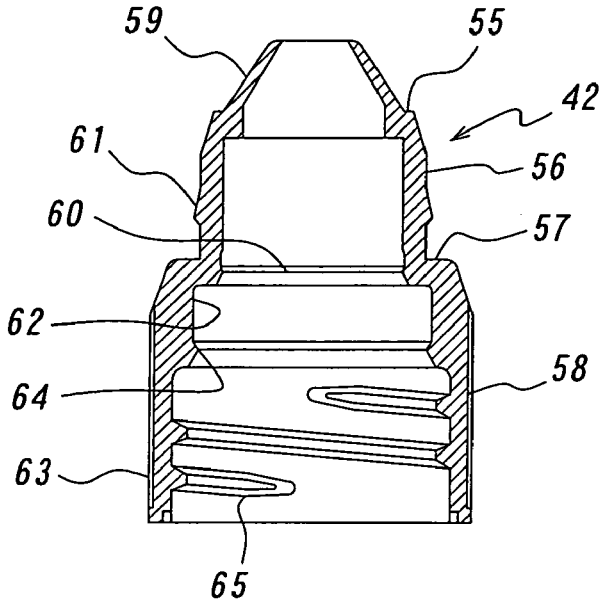
FIG. 6 is a longitudinal sectional view illustrating an attachment cap.

As shown in FIG. 6, the attachment cap 42 comprises an upper peripheral wall 56 formed with an upper wall 55 and a lower peripheral wall 58 connected to the upper peripheral wall 56 through the intermediary of a stepped part 57. The upper wall 55 is provided with a bristle bundling barrel 59 having a circular lower end and an elliptic upper end having an area smaller than that of the lower end, for bundling bristle 52, the bristle bundling barrel 59 standing upward along the inner peripheral edge of the upper wall 55. The upper peripheral wall 56 is formed at the lower end of the inner periphery thereof with a bead ring 60, and at a predetermined position in lower end part of the outer periphery thereof with a projecting ring 61 projected outward. The lower peripheral wall 58 has at its inner surface an upper reduced diameter part 62 and a lower thread barrel part 63. Further, the reduced diameter part 62 is formed at its inner barrel end with a bead ring 44 which is adapted to be engaged with the locking ring 27 of the barrel part 24 when it is raised, and thread 65 are spirally formed in the thread barrel part 63.

With reference to FIG. 1, the cover cap 14 is composed of a top wall 70 and a peripheral wall 71 which is formed in its lower part with a bear ring 72 adapted to be coupled with the projecting ring 61 when the lower end thereof abuts against the stepper part 57 of the attachment cap 13.

Explanation will be made of a method of assembling the liquid applicator in the above-mentioned embodiment, the using mode and the technical effects and advantages thereof.

First, upon the assembly of the application member 13, the discharge barrel 40 is fitted into the bristle holding part 41 planted thereon with the bristle 52 so as to cause the lower surface of the discharge barrel holding part 49 to abut against the upper surface of the flange 45, and to cause the bead ring 53 at the lower surface of the inner periphery of the discharge barrel holding part 49 to engage with the lower end edge of the projecting ring 46 at the peripheral edge of the flange 45 in order to couple the discharge barrel 40 with the bristle holder 41.

Figure 7A:
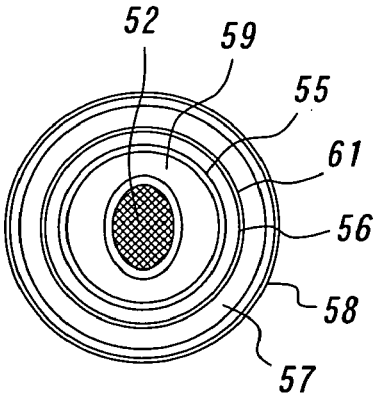
FIGS. 7*a* and 7*b* are a plan view and a longitudinal sectional view, respectively, illustrating an application member.
Figure 7B:
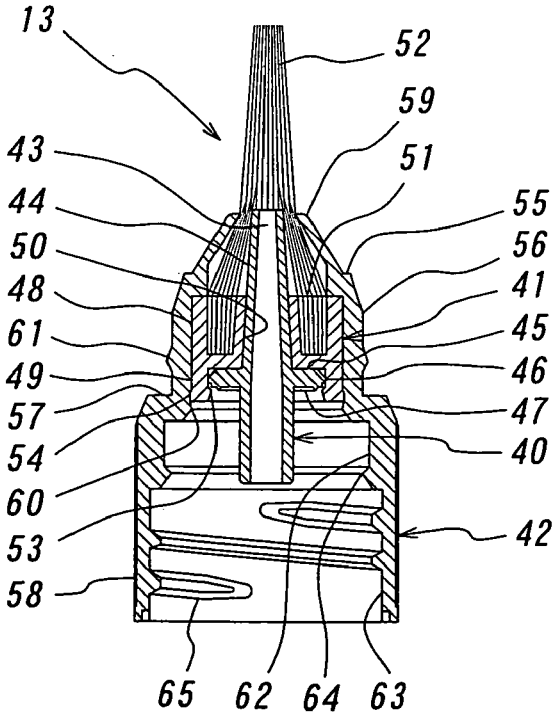

Next, the bristle holder 41 is fitted in the attachment cap 42 from therebelow, and the bristle 52 is bundled in the bristle bundling barrel 59 in a predetermined shape, and is raised so as to cause the projecting ring 54 at the lower end of the bristle holder 41 to clime riding over the bead ring 60 of the upper peripheral wall 56. As a result, the bead ring 60 is engaged with the lower side of the projecting ring 54, and accordingly, the discharge barrel 40, the bristle holder 41 and the attachment cap 42 are integrally incorporated with one another, as shown in FIGS. 7*a* and 7*b*.

Upon the attachment of the application member 13 to the container 11, when the attachment cap 42 is rotated so as to be screwed onto the barrel part 24, the attachment cap 42 is lowered, and accordingly, the bead ring 64 is engaged with the locking ring 27 so as to cause click action. When the attachment cap 42 is further rotated, the bead ring 64 rides over the locking ring 27 so that the attachment cap 22 is further lowered down to a lowermost position. In this condition, the lower end of the discharge barrel 40 abuts against the bottom wall 32 of the inner plug 12, and accordingly, the barrel body 44 of the discharge barrel 40 closes the passage holes 34 which are therefore blocked.

Figure 8:
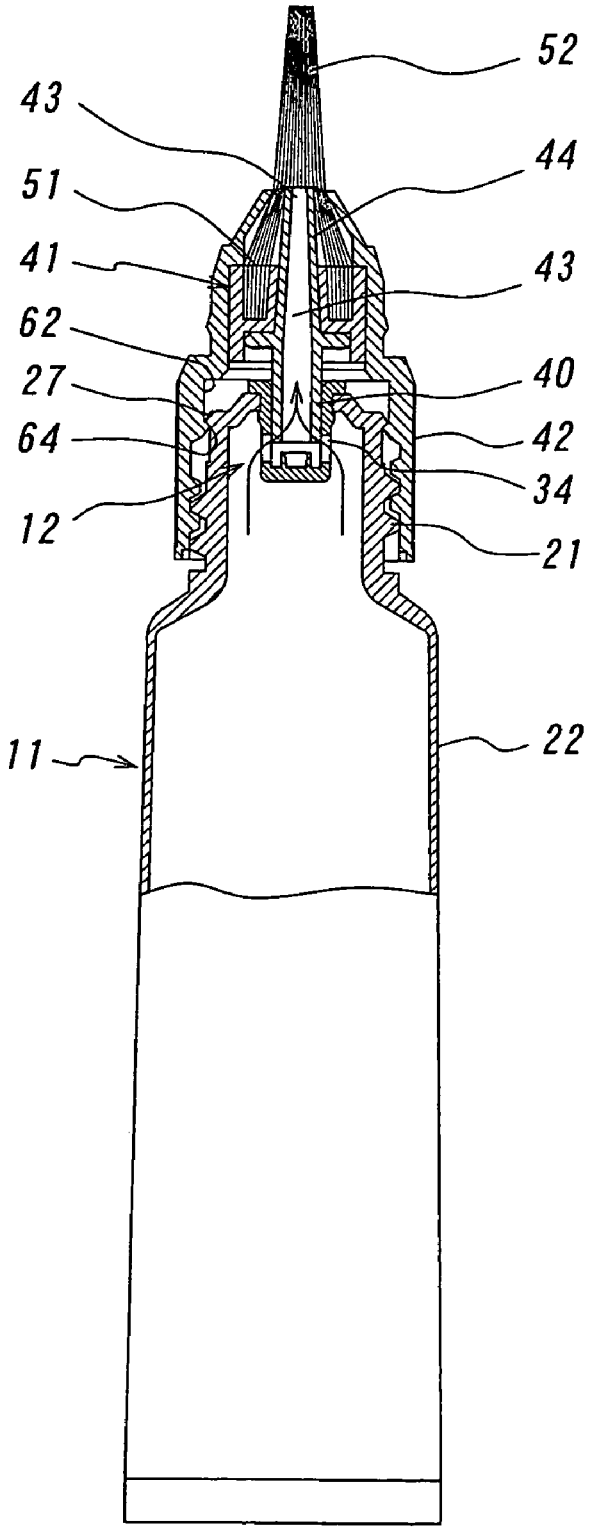
FIG. 8 is an elevation view, similar to FIG. 1, illustrating the liquid applicator when the application member is raised.

Upon use of the liquid applicator, as shown in FIG. 8, after the cover cap 14 is removed, when the attachment cap 42 is rotated so as to be raised, the bead ring 64 at the inner periphery of the attachment cap 42 is engaged with the locking ring 27 projected from the mouth portion 21, and accordingly, it is inhibited from being raised any further, and clicking action is transmitted to the operator's hand. Until then, the discharge barrel 40 of the applicator member 13 rises up so as to open the passage holes 34 in the peripheral wall 21 of the inner plug 12, that is, the inside of the container 11 is communicated with the discharge hole 43 of the discharge barrel 40, and accordingly, when the barrel 22 is pressed, the liquid contents can be discharged into the bristle 52.

The bristle 52 is pushed against a desired surface to be applied and is then moved, the contents can be applied over a desired area to be applied. After the application is completed, when the attachment cap 42 is closed, the passage holes 34 in the inner plug 12 are closed, and accordingly, the liquid contents can be prevented from accidentally flowing out from the container even though the container barrel 22 is pressed.

In the case of contamination to the application member 13, the attachment cap 42 is raised until the bead ring 64 abuts against the locking ring 27 of the mouth portion 21 of the container, and then by further rotating the attachment cap 42, the bead ring 64 rises up, riding over the locking ring 27. As a result, the thread engagement of the attachment cap 42 is released, and accordingly, the application member 13 can be removed from the container 11. The application member 13 thus removed is soaked and washed in water or washing liquid, thereby it is possible to remove dirt, dust or useless liquid sticking to the bristle.

Next, explanation will be made of variant forms of the inner plug and the discharge barrel with reference to the drawings.

Figure 9A:
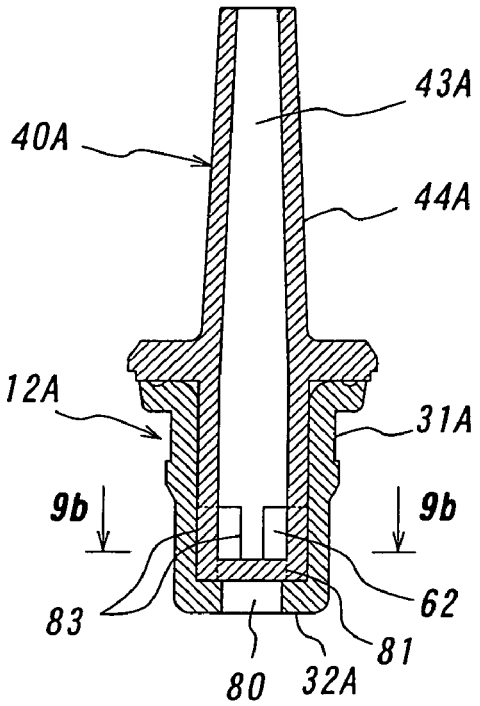
FIG. 9*a* is a longitudinal view illustrating the inner plug and the discharge barrel according to a first variant.
Figure 9B:
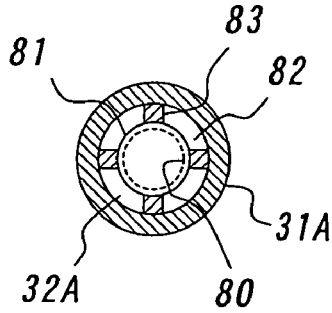
FIG. 9*b* is a cross-sectional view taken along the line 9*b*-9*b* in FIG. 9*a*.

At first, with reference to FIGS. 9*a* and 9*b*, explanation will be made of a first variant. In these figures, there are shown an inner plug 12A and a discharge barrel 40A. The inner plug 12A has a peripheral wall 31A and a bottom wall 32A which is formed therein a valve hole 80 as a passage hole. A barrel body 44A in the discharge barrel 40A is provided at its lower end with a valve element 81, and is formed therein with a plurality of passages 82 extending up to a predetermined height measured from the valve element 81 while frame elements 83 separating the passages 82 from one another serve as support bars for the valve element 81. Upon discharge of the contents, the application member is raised while the valve element 81 at the lower end of the discharge barrel 40A is raised so as to open the valve hole 80, and accordingly, the contents flow from the valve hole 80 into the discharge hole 43A by way of the peripheral edges of the valve element 81 in the discharge barrel 40A and the passages 82, and are then discharged from the upper end of the discharge barrel 40A into the bristle.

Figure 10A:
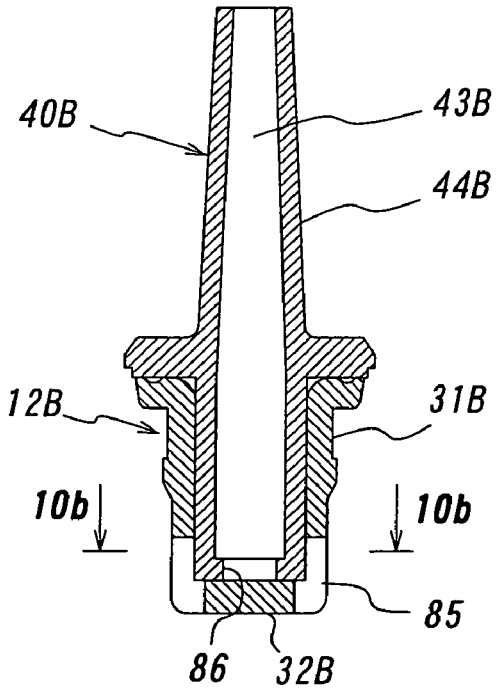
FIG. 10*a* is a longitudinal sectional view illustrating the inner plug and the discharge barrel according to a second variant.
Figure 10B:
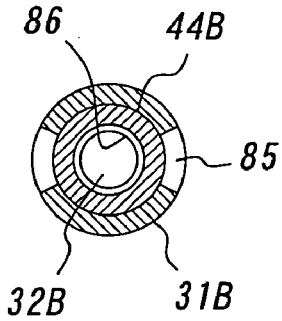
FIG. 10*b* is a cross-sectional taken view along the line 10*b*-10*b* in FIG. 10*a*.

With reference to FIGS. 10*a* and 10*b*, explanation will be made of a second variant. In these figures, there are shown an inner plug 12B, the discharge barrel 40B. The inner plug 12B has a peripheral wall 31B and a bottom wall 32B which is formed with passage holes 85 extending from positions near to the lower end of the peripheral wall 31B to the peripheral edge part of the bottom wall 32B. A barrel body 44B of the discharge barrel 40B is formed at the lower end thereof with a projecting ring 86 extending into a discharge hole 43B, and the projecting ring 86 is adapted to completely block the passage holes 85 in the bottom wall 32B. Upon discharge of the contents, the discharge barrel 40B is raised so as to open the passage holes 85, and accordingly, the contents flow into the discharge hole 43B by way of the passage holes 85, and are then discharged into the bristle from the upper end of the discharge barrel 40B.

Figure 11A:
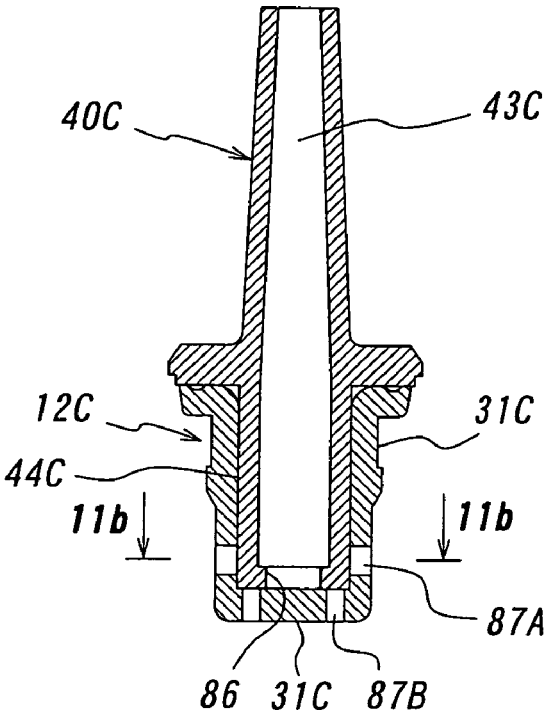
FIG. 11*a* is a longitudinal sectional view illustrating the inner plug and the discharge barrel according to a third variant.
Figure 11B:
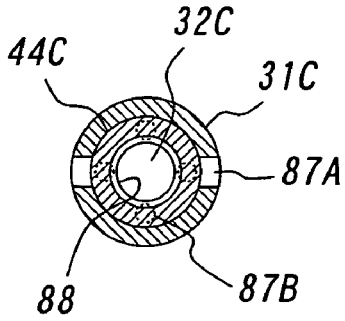
FIG. 11*b* is a cross-sectional view taken along the line 11*b*-11*b* in FIG. 11*a*.

With reference to FIGS. 11*a* and 11*b*, explanation will be made of a third variant. In these figures, there are shown an inner plug 12C and a discharge barrel 40C. The inner plug 12C has a peripheral wall 31C and a bottom wall 32C. The peripheral wall 31C is formed with passage holes 87A having a large diameter, and the bottom wall 32C is formed with passage holes 87B having a small diameter. A barrel body 44C of the discharge barrel 40C is formed at the lower end thereof with a projecting ring 88 extending into a discharge hole 43C, and accordingly, the passage holes 87A are blocked by the barrel body 44C while the passage holes 87B in the bottom wall 32C are blocked by the projecting ring 88. Upon discharge of the contents, when the discharge barrel 40C is raised, the passage holes 87A, 87B are opened so that the contents flow into the discharge hole 43C by way of the passage holes 87A, 87B, and accordingly, they can be discharged into the bristle from the upper end of the discharge barrel 40C.

Figure 12:
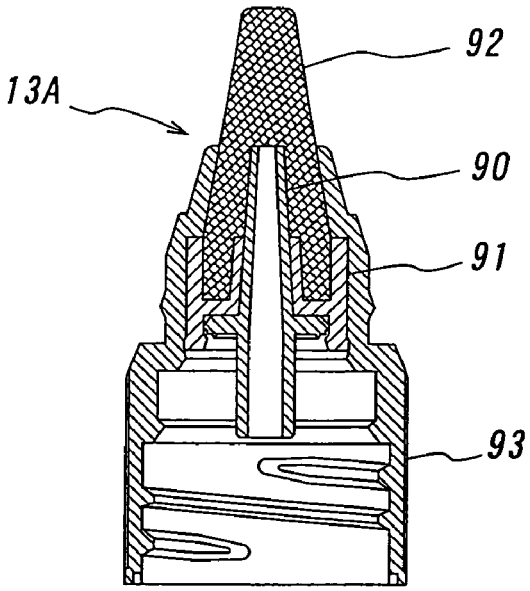
FIG. 12 is a longitudinal sectional view illustrating an application element in another embodiment.

Next, explanation will be made of another embodiment as to an applicator member as shown in FIG. 12. In this embodiment, a porous application element formed of sponge, felt or the like is used as the application element, instead of the bristle. With reference to FIG. 12, there are shown an application member 13A, a discharge barrel 90, an application element holder 91, an application element 92 formed of sponge or felt made of synthetic resin, synthetic rubber or the like, and an attachment cap 93. Although the embodiment shown in FIG. 12 is different from the above-mentioned embodiment in view of such a fact that the porous application element 92 is used, the other components including the discharge barrel 90 are substantially similar to those explained in the above-mentioned embodiment shown in FIGS. 1 to 8. Upon discharge of the contents, there may be obtained working which is substantially similar to that obtained by the liquid applicator in the above-mentioned embodiment.

In the embodiments as stated above, although container is in the form of a tube container, it is also possible to use a usual squeeze container or the like, instead of the tube container.

Furthermore, according to the present invention, cosmetics such as lip cream or lip color, chemicals or the like are stored in the container which is therefore used as an applicator, though it may be used as an applicator for viscous liquid such as paste, adhesive, paint or the like.

What is claimed is:

1. A liquid applicator comprising:

a container including a mouth portion having a barrel part formed with threads;

an inner plug including a peripheral wall fitted in the mouth portion of the container, and a bottom wall, and formed therein with a passage hole communicated with the inside of the container; and an application member including a discharge barrel for opening and closing the passage hole in the inner plug, an application element holder fitted therein with the discharge barrel and holding an application element, and an attachment cap formed with threads that can be threadedly engaged with the threads of the mouth portion.

2. A liquid applicator according to claim 1, wherein the mouth portion of the container is formed at the upper end part thereof with a locking ring projecting therefrom, and the attachment cap is formed at the inner surface thereof with a bead ring adapted to be engaged with the locking ring, the locking ring of the mouth portion limiting the rising position of the attachment cap, and allowing the bead ring to ride over the locking ring by further rotating the attachment cap.

3. A liquid applicator according to claim 2, wherein the application element is a bristle.

4. A liquid applicator according to claim 2, wherein the application element is a porous application element.

5. A liquid applicator according to claim 2, wherein the passage hole of the inner plug is formed in at least one of the peripheral wall and the bottom wall.

6. A liquid applicator according to claim 1, wherein the application element is a bristle.

7. A liquid applicator according to claim 1, wherein the application element is a porous application element.

8. A liquid applicator according to claim 1, wherein the passage hole of the inner plug is formed in at least one of the peripheral wall and the bottom wall.

* * * * *